US005178789A

United States Patent [19]

Estell

[11] Patent Number: 5,178,789

[45] Date of Patent: Jan. 12, 1993

[54] LIQUID DETERGENT WITH STABILIZED ENZYME

[75] Inventor: David A. Estell, San Mateo, Calif.

[73] Assignee: Genencor International, Inc., Rochester, N.Y.

[21] Appl. No.: 722,028

[22] Filed: Jun. 27, 1991

[51] Int. Cl.[5] ..... C11D 3/386; C11D 3/384

[52] U.S. Cl. ..... 252/174.12; 252/DIG. 12; 252/DIG. 2; 435/264; 435/184; 435/188

[58] Field of Search ..... 252/174.12, DIG. 12, 252/DIG.2; 435/264, 188, 184

[56] References Cited

U.S. PATENT DOCUMENTS

| | | | |
|---|---|---|---|
| 4,169,817 | 2/1979 | Weber | 252/174.12 |
| 4,261,868 | 4/1981 | Hora et al. | 252/174.12 |
| 4,318,818 | 9/1982 | Letton | 252/174.12 |
| 4,959,179 | 9/1990 | Aronson et al. | 252/174.12 |
| 5,037,292 | 12/1991 | Hessell et al. | 252/174.12 |
| 5,039,446 | 8/1991 | Estell et al. | 252/174.12 |

FOREIGN PATENT DOCUMENTS

| | | | |
|---|---|---|---|
| 0065800 | 12/1982 | European Pat. Off. | 252/174.12 |
| 0341183 | 12/1989 | European Pat. Off. | 252/174.12 |

OTHER PUBLICATIONS

Empie et al. "Thermodynamics and Kinetics of Single Residue Replacement in Avian Ovomucoid Third Domain: Effect on Inhibitor Interactions with Serine Proteinases" vol. 21, No. 2 1982 pp. 2274–2284.

Park et al., "Covalent Hybrids of Ovomucoid Third Domain Made From One Synthetic and One Natural Pestide Bond" vol. 144, No. 1, 499–504.

*Primary Examiner*—Paul Lieberman

*Assistant Examiner*—Kery A. Fries

*Attorney, Agent, or Firm*—Margaret A. Horn

[57] ABSTRACT

Liquid detergent containing enzymes particularly proteases are stabilized against enzyme degradation prior to use by inclusion of an inhibitor of the enzyme which binds to the enzyme such that prior to use of the detergent at least about 90% of the enzyme is bound to the enzyme inhibitor essentially at the enzyme active site. Such enzyme inhibitor so selected can be used effectively in concentrations much lower than previously taught.

10 Claims, No Drawings

LIQUID DETERGENT WITH STABILIZED ENZYME

BACKGROUND OF THE INVENTION

1. Field of the Invention

The present invention relates to enzyme compositions and liquid detergent compositions. Particularly, the invention relates to enzymes which are been stabilized and to liquid laundry detergents with the stabilized enzymes.

2. Background Art

The development of detergents for the cleaning of fabric have improved steadily over the recent past. Improvements in detergent additives have included improvements of surfactants, builders, dispersing agents, fluorescent whitening agents, bleaching agents, etc. and have allowed detergents to be formulated into powders, granules and liquids. See e.g., detergents composition in U.S. Pat. Nos. 3,551,002, 3,558,498, 3,623,957, 3,749,671, 3,790,482, 3,985,686, 4,090,973, 4,011,169, 4,111,855, 4,142,999, 4,242,219, 4,261,868, 4,318,818, 4,404,115, and 4,381,247 incorporated herein by reference.

Detergent compositions often contain enzymes (e.g., a protease) to aid in the degradation and removal of enzyme sensitive stains, soils and deposits. Detergent formulations which contain enzymes, however, experience the problem of decreased enzyme activity over time, especially liquid detergents which contain high levels of surfactant and water. Enzymes may hydrolyze in water and often a protease will degrade itself or other enzymes that may be present. Surfactants, for example alkyl sulfates, tend to deactivate enzymes and render them inactive. Detergent builders can sequester the calcium ion needed for enzyme stability. These problems require either an expiration date on the detergent or the undesirable alternative of an increased amount of costly enzyme being added to the detergent. There is a continuing need, therefore, for liquid detergents which contain enzymes which are stabilized and exhibit a greater activity over time. The prior art has attempted to deal with these problems.

Meister, U.S. Pat. No. 3,095,358, utilizes sorbitol to stabilize aqueous solutions containing enzymes such as papain and mixtures of protease and amylase obtained from Bacillus subtilis. This method also requires large amounts of stabilizing agent. Several patents list compounds which stabilize enzymes. However, none of the following are competitive inhibitors.

Cayle, U.S. Pat. No. 3,296,094, utilizes partially hydrolyzed and solubilized collagen and glycerol to stabilize aqueous solutions of proteolytic enzymes. This method requires large quantities of glycerol by weight of the total solution and, therefore, adds significantly to the cost of the enzyme solution.

McCarty, U.S. Pat. No. 3,557,002, uses short chain alkyl or alkoxy alkyl monohydroxy alcohols to stabilize enzyme preparations. These preparations will protect at least 50% of the listed enzyme's activity after storage at 100° F. for 5 weeks. Diehl, U.S. Pat. No. 4,011,169, uses aminated polysaccharides such as aminated cellulose to stabilize enzymatic activity. In U.S. Pat. No. 4,142,999, Bloching uses mono and polyvalent alcohols and ethers thereof, and an effective amount of an alkoxylated alkylamine to stabilize enzyme activity.

U.S. Pat. No. 4,261,868, Hora et al, issued Apr. 4, 1981, discloses liquid detergents containing enzymes and, as an enzyme-stabilizing system 2–25% of a polyfunctional amino compound selected from diethanolamine, triethanolamine, diisopropanolamine, triisopropanolimine and tris(hydroxymethyl) aminomethane, and 0.25–15% of a boron compound selected from boric acid, boric oxide, borax, and sodium ortho, meta and pyroborate. The compositions can contain 10–60% surfactant, including anionics, and up to 40% builder.

U.S. Pat. No. 4,318,818, Letton et al, issued Mar. 9, 1982, discloses liquid detergents containing enzymes and an enzyme-stabilizing system comprising calcium ion and a low molecular weight carboxylic acid or salt, preferably a formate. The compositions preferably contain from about 20% to 50% surfactant, which can be anionic. In a preferred embodiment, the compositions contain about 3% to 15% of a saturated fatty acid. They are otherwise substantially free of builders, but can contain minor amounts of sequestrants.

Commonly assigned, U.S. Pat. No. 5,039,446 discloses liquid detergents containing enzymes and an enzyme-stabilizing system comprising an enzyme inhibitor which is leupeptin and is incorporated herein by reference.

U.S. Pat. No. 4,404,115, Tai, issued Sep. 13, 1983, discloses liquid cleaning compositions, preferably built liquid detergents, containing enzyme, 1–15% alkali metal pentaborate, 0–15% alkali metal sulfite, and 0–15% of a polyol having 2–6 hydroxy groups. The compositions can contain 1–60% surfactant, preferably a mixture of anionic and non-ionic in a weight ratio of 6:1 to 1:1, with or without soap. The compositions also preferably contain 5–50% builder.

European Patent Application 0,130,756, published Jan. 9, 1985, discloses proteolytic enzymes useful herein and methods for their preparation. The enzymes are said to be useful in laundry detergents, both liquid and granular. They can be combined with surfactants (including anionics), builders, bleach an/or fluorescent whitening agents, but there is no disclosure of specific detergent compositions.

European Patent Application 0,199,405 published Oct. 10, 1986 discloses liquid detergent compositions containing synthetic surfactants, an enzyme and boric acid or boron compound from about 0.1% to about 10%, preferably from 0.25% to 5%, and most preferably from about 0.5% to about 3%. No disclosure is made, however, of how to match the enzyme with the boric acid. As a percentage of the enzyme, the boric acid represents at least 2% up to 100,000%.

The art is illustrative of the cost and expense that has gone into stabilization of enzymes by way of adding large amounts of additional ingredients as well as the difficulties in dilution which occur due to varying teachings of the amounts of stabilizing agent which must be added based on the amount of water and other ingredient present.

It is an object of the invention therefore to stabilize enzymes and enzymes in liquid detergents with a minimum standardized amount of a stabilizer in the presence of water, detergents or other, if any, ingredients present in the liquid detergent and at a minimum cost to the manufacturer and consumer.

SUMMARY OF THE INVENTION

In accordance therewith it has been discovered that enzymes can be stabilized against such problems. The invention relates to a liquid detergent composition comprising:

a) from about 1% to about 75% of a surfactant;

b) from about 10% to about 95% of water by weight;

c) from about 0.1% to about 5% of an enzyme suitable for use in detergent compositions; and d) an effective amount of an enzyme inhibitor such that prior to use of the detergent, the enzyme inhibitor binds at least about 90% of the enzyme and the remaining enzyme is in its free form, and wherein upon dilution of the composition to between 2 and 10,000 times, at least about 25% of such bound enzyme is released in its free form.

The invention also relates to a stabilized enzyme composition comprising:

a) an enzyme suitable for use in detergent compositions; and b) an effective amount of an enzyme inhibitor such that at least about 90% of the enzyme is bound to the enzyme inhibitor and that the remaining unbound enzyme is in its free form, and wherein upon dilution of the composition to between 2 and 10,000 times, at least about 25% of such bound enzyme is released in its free form.

DETAILED DESCRIPTION OF THE INVENTION

Basic liquid detergent compositions contain a surfactant, preferably a non-ionic or anionic surfactant and from about 10% to about 95% water on a weight basis in addition to the enzyme and enzyme inhibitor. Varying amounts of stabilizers have been taught, but in general the inhibitor is taught to be at least 0.1% of the detergent composition.

The preferred compositions of the present invention contain from about 1% to about 75%, preferably from about 10% to about 40% and most preferably from about 15% to about 30%, by weight of a surfactant. Suitable anionic synthetic surfactants are disclosed in U.S. Pat. No. 4,111,855, Barrat et al, issued Aug. 25, 1981, and in U.S. Pat. No. 3,929,678, Laughlin et al, issued Dec. 30, 1975, both incorporated herein by reference.

Useful anionic surfactants also include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion or aryl groups.) Examples of this group of synthetic surfactants are the alkyl sulfates, especially those obtained by sulfating the higher alcohols ($C_8$–$C_{18}$ carbon atoms) such as those produced by reducing the glycerides of tallow or coconut oil; and the alkylbenzene sulfonates in which the alkyl group contains from about 9 to 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 14.

Other anionic surfactants herein are the water-soluble salts of: paraffin sulfonates containing from about 8 to about 24 (preferably about 12 to 18) carbon atoms; alkyl glyceryl ether sulfonates, especially those ethers of $C_{8-18}$ alcohols (e.g., those derived from tallow and coconut oil); alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group.

Other useful anionic surfactants include the water-soluble salts of esters of alpha-sulfonated fatty acids containing from about 6 to 20 carbon atoms in the fatty acid group and from about 1 to 10 carbon atoms in the ester group: water-soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and beta-alkyloxy alkane sulfonates containing from about 1 to 3 carbon atoms in the alkyl group and from about 8 to 20 carbon atoms in the alkane moiety.

Preferred anionic surfactants are the $C_{11}$–$C_{13}$ linear alkylbenzene sulfonates, and mixtures thereof.

The compositions preferably contain from about 1% to about 5%, more preferably from about 2% to about 4%, by weight of unethoxylated alkyl sulfate. These alkyl sulfates are desired for best detergency performance, in part because they are very denaturing to stains.

The composition herein can optionally contain other synthetic surfactants known in the art, such as the non-ionic, cationic, zwitterionic, and ampholytic surfactants described in the above-cited Barrat et al and Laughlin et al patents.

A preferred cosurfactant, used at a level of from about 1% to about 25% preferably from about 3% to about 15%, by weight of the composition, is an ethoxylated non-ionic surfactant of the formula $R^1(OC_2H_4)_nOH$, wherein $R^1$ is a $C_{10}$–$C_{16}$ alkyl group or a $C_8$–$C_{12}$ alkyl phenyl group, n is from about 3 to about 9, and said non-ionic surfactant has an HLB (hydrophile-lipophile balance) of from about 6 to about 14, preferably from about 10 to about 13. These surfactants are more fully described in U.S. Pat. No. 4,285,841, Barrat et al, issued Aug. 25, 1981, and U.S. Pat. No. 4,284,532, Leikhim et al, issue Aug. 18, 1981, both incorporated herein by reference. Particularly preferred are condensation products of $C_{12}$–$C_{15}$ alcohols with from about 3 to about 8 moles of ethylene oxide per mole of alcohol, e.g., $C_{12}$–$C_{13}$ alcohol condensed with about 6.5 moles of ethylene oxide per mole of alcohol.

Preferred cosurfactants for use with the above ethoxylated non-ionic surfactants are amides of the formula

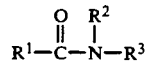

wherein $R^1$ is an alkyl, hydroxylakyl or alkenyl radical containing from about 8 to about 20 carbon atoms, and $R^2$ and $R^3$ are selected from the group consisting of hydrogen, methyl, ethyl, propyl, isopropyl, 2-hydroxyethyl, 2-hydroxypropyl, 3-hydroxypropyl, and said radicals additionally containing up to about 5 ethylene oxide units, provided at least one of $R^2$ and $R^3$ contains a hydroxyl group.

Preferred amides are the $C_8$–$C_{20}$ fatty acid alkylol amides in which each alkylol group contains from 1 to 3 carbon atoms, and additionally can contain up to about 2 ethylene oxide units. Particularly preferred are the $C_{12}$–$C_{16}$ fatty acid monoethanol and diethanol amides.

Certain compositions herein preferably contain from about 5% to about 20%, preferably from about 6% to about 15%, more preferably from about 7% to about 12%, by weight of a mixture of the above ethoxylated non-ionic surfactant and amide surfactant in a weight ratio of from about 4:1 to 1:4, preferably from about 3:1 to about 1:3, more preferably from about 2:1 to about 1:2. In addition, the weight ratio of anionic synthetic surfactant (on an acid basis) to the total non-ionic surfactant (both the ethoxylated non-ionic and the amide) should be from about 2:1 to about 4:1, preferably from about 2.5:1 to about 3.5:1, to ensure the formation and adsorption of sufficient hardness surfactants at the oil/water interface to provide good greasy/oily soil removal.

Other preferred cosurfactants, used at a level of from about 0.5% to about 3%, preferably from about 0.7% to about 2%, by weight are the quaternary ammonium, amine or amine oxide surfactants described in U.S. Pat. No. 4,507,219, Hughes, issued Mar. 26, 1985, incorporated herein, by reference.

While the compositions herein can contain di-long chain quaternary ammonium cationic surfactants (e.g., those having 2 chains, each containing an average of from about 16 to about 22 carbon atoms), such as disclosed in British Patent 2,041,968, Murphy, published Sep. 19, 1979, incorporated herein by reference, the compositions preferably contain less than about 2%, more preferably less than about 1%, by weight of such surfactants. Most preferably, the compositions are substantially free of such surfactants, because they appear to be detrimental to the stability of the enzymes herein.

The compositions herein optionally contain from about 5% to about 40%, preferably from about 8% to about 30%, more preferably from about 10% to about 25%, by weight of a detergent builder material. In addition, the composition should contain at least about 20%, preferably from about 25% to about 60%, more preferably from about 30% to about 50%, by weight of the anionic synthetic surfactant and builder.

Useful builders are fatty acids containing from about 10 to about 22 carbon atoms. Preferred are saturated fatty acids containing from about 10 to about 18, preferably from about 10 to about 14, carbon atoms. When present, the fatty acid preferably represents about 5% to about 20%, more preferably from about 8% to about 16%, by weight of the composition.

Suitable saturated fatty acids can be obtained from natural sources such as plant or animal esters (e.g., palm kernel oil, palm oil and coconut oil) or synthetically prepared (e.g., via the oxidation of petroleum or by hydrogenation of carbon monoxide via the Fister-Tropsch process). Examples of suitable saturated fatty acids for use in the compositions of this invention include capric, lauric, myristic, coconut and palm kernel fatty acid. Preferred are saturated coconut fatty acids from about 5:1 to 1:1 (preferably about 3:1) weight ratio mixtures of lauric an myristic acid; mixtures of the above with minor amounts (e.g., 1%–30% of total fatty acid) of oleic acid; and palm kernel fatty acid.

Detergent builders useful herein also include the polycarboxylate, polyphosphonate and polyphosphate builders described in U.S. Pat. No. 4,284,532, Leikhim et al, issued Aug. 18, 1981, incorporated herein by reference. Water-soluble polycarboxylate builders, particularly citrates, are preferred of this group. Polycarboxylate builders preferably represent from about 1% to about 20% by weight of the composition.

Suitable polycarboxylate builders include the various aminopolycarboxylates, cycloalkane polycarboxylates, ether polycarboxylates, alkyl polycarboxylate, epoxy polycarboxylates, tetrahydrofuran polycarboxylates, benzene polycarboxylates, and polyacetal polycarboxylates.

Examples of such polycarboxylate builders are sodium and potassium ethylenediaminetetraacetate; sodium and potassium nitrilotriacetate; the water-soluble salts of phytic acid, e.g., sodium and potassium phytates, disclose in U.S. Pat. No. 1,739,942, Eckey, issued Mar. 27, 1956, incorporated herein by reference; the polycarboxylate materials described in U.S. Pat. No. 3,364,103, incorporated herein by reference.

Useful detergent builders also include the water-soluble salts of polymeric aliphatic polycarboxylic acids having the following structural and physical characteristics: (a) a minimum molecular weight of about 350 calculated as to the acid form; (b) an equivalent weight of about 50 to about 80 calculated as to acid form; (c) at least 45 mole percent of the monomeric species having at least two carboxyl radicals separated from each other by not more than two carbon atoms; (d) the site of attachment of the polymer chain of any carboxyl-containing radical being separated by not more than three carbon atoms along the polymer chain from the site of attachment of the next carboxyl-containing radical. Specific examples of such builders are the polymers and copolymers of itaconic acid, aconitic acid, maleic acid, mesaconic acid, fumaric acid, methylene malonic acid, and citraconic acid.

Other suitable polycarboxylate builders include the water-soluble salts, especially the sodium and potassium salts, of mellitic acid, citric acid, pyromellitic acid, benzene pentacarboxylic acid, oxydiacetic acid, carboxymethyloxysuccinic acid, carboxymethyloxymalonic acid, cis-cyclohexanehexacarboxylic acid, cis-cylopentanetetracarboxylic acid and oxydisuccinic acid.

Other polycarboxylates for use herein are the polyacetal carboxylates described in U.S. Pat. No. 4,144,226, issued Mar. 13, 1979 to Crutchfield et al, and U.S. Pat. No. 4,146,495, issued Mar. 27, 1979 to Crutchfield et al, both incorporated herein by reference.

Other detergent builders useful herein include the aluminosilicate ion exchange material described in U.S. Pat. No. 4,405,483, Kuzel et al, issued Sep. 20, 1983, incorporated herein by reference.

As part of the builder system, the compositions herein preferably contain from about 0.1% to about 1%, more preferably from about 0.2% to about 0.6% by weight of water-soluble salts of ethylenediamine tetramethylenephosphonic acid, diethylenetriamine pentamethylenephosphonic acid, ethylenediamine tetraacetic acid, or diethylenetriamine pentaacetic acid to enhance cleaning performance when pretreating fabrics.

Enzymes for inclusion in liquid detergent compositions of the invention are those suitable for use in detergent compositions and are well known in the art as discussed above. The preferred enzymes are proteases such as subtilisin, and amylases such as those from bacillus species. Preferred proteases are also those described in European Patent Applications 130,756 published Jan. 9, 1985, and incorporated herein by reference. One or more enzymes may be included in the composition.

The above enzyme is preferably included in an amount sufficient to provide an activity of from about 0.001 to about 0.1, more preferably from about 0.005 to about 0.07, most preferably from about 0.01 to about 0.04, Anson units per gram of composition. On a percentage basis of the composition, it is preferable that it be from about 0.01% to about 5% by weight of the liquid detergent composition. The enzymes useful herein are preferably purified, prior to incorporation in the finished composition, so that they have no detectable odor at a concentration of less than about 0.002 Anson units per gram in distilled water. They preferably have no detectable odor at a concentration of less than about 0.0025, more preferably less than about 0.003, Anson units per gram of distilled water.

The compositions herein have an initial pH of from about 6.5 to about 9.5, preferably from about 7 to about 8.5, most preferably from about 7.2 to about 8.0, at a concentration of 0.2% by weight in distilled water at 20° C. Preferred pH buffers include monethanolamine and triethanolamine. Monethanolamine and triethanolamine also further enhance enzyme stability, and preferably are included at levels of from about 0.5% to about 10%, preferably from about 1% to about 4%, by weight of the composition.

Other optional components for use in the liquid detergents herein include soil removal agents, antiredeposition agents, suds regulants, hydrotropes, opacifiers, antioxidants, bactericides, dyes, perfumes, and brighteners known in the art. Such optional components generally represent less than about 15%, preferably from about 1% to about 10%, by weight of the composition.

The enzyme inhibitor of the invention is selected to be a competitive inhibitor of the selected enzyme. By specifically selecting a competitive inhibitor as follows, substantially less enzyme can be used. The enzyme inhibitor is chosen in an amount such that at least about 90% of the enzyme is bound to the enzyme inhibitor at essentially the active site of the enzyme to an extent that the remaining unbound enzyme is in its free form in the composition, yet a dilution of the liquid detergent composition with water or other appropriate liquid of from about 2 to about 10,000 times or a dilution of the enzyme composition with water, detergent, or other appropriate liquid from about 2 to about 100,000 times, at least about 25% of such bound enzyme is released in its free form.

Preferably the competitive inhibitor is present in an amount to bind at least about 90% of the enzyme prior to dilution and such that upon dilution at least about 45% of such bound enzyme is released in its active form. Most preferably, the enzyme inhibitor is turkey ovomucoid (TOM) and the enzyme to be selectively inhibited is a protease such as subtilisin.

Experimental

INHIBITION ASSAY

The inhibitor solution is made up in a 20 mM Mops, pH 7 buffer and added to an eppendorf. 0.8 mM subtilisin is added and the mixture is allowed to incubate at room temperature for 15 minutes. After 15 minutes, 99 μl of the mixture is added to a cuvette containing 10 μl of 100 mg/ml SAAApna. The rate of hydrolysis is monitored at 410 rpm. A subtilisin control containing no inhibitor is carried out. Results are shown in Table I.

DILUTION ASSAY

The above inhibition assay is diluted 1:10 into the standard subtilisin assay buffer (0.1M Tris, pH 8.6 with 0.005% Tween). 10 μl of this diluted material is then added to a cuvette containing 10 μl of 100 mg/ml SAAPFpna and 980 μl subtilisin Assay Buffer. The rate of reaction is followed at 410 nm. The final dilution is 1:1000. Data are shown in Table I.

TABLE I

| Inhibitor | Inhibition Assay % Inhibition | Dilution Assay % Recovered Activity |
|---|---|---|
| Control | 0 | 100 |
| 0.4 mg/ml TOM | 82 | 32 |
| 2 mg/ml TOM | 97 | 45 |

Lipase and Subtilisin Stability In Presence of TOM 2 mg/ml of TOM was added to Tide TM Liquid (commercially available from The Procter & Gamble Co). The solution was diluted 1/500 into the standard subtilisin 8.6 Tris buffer. 10 μl aliquots were taken at various times to monitor subtilisin activity. Similar dilutions and assay procedures were carried out with Tide TM Liquid. 100 mg/ml SAAPFpna substrate was used. Data are shown in Table II.

TABLE II

| Inibition of Subtilisin by TOM In the Presence of Tide TM Liquid | | | |
|---|---|---|---|
| Time (min) | Tide* Activity | Tide* 2 mg/ml TOM | % Activity Recovered Upon Dilution |
| 0 | 2.25 | 1.04 | 46 |
| 15 | 2.54 | 0.97 | 38 |
| 30 | 2.96 | 0.965 | 33 |

*Tide TM Liquid contains subtilisin at approximately 21 mg/ml.

The data in Tables I and II show that inhibition of subtilisin with about 2 mg/ml TOM inhibits enzyme activity by binding at least 90% of active enzyme, and immediately upon appropriate dilution >25% of enzyme activity (46%) is recovered via release of bound enzyme to its active form.

What is claimed is:

1. A liquid detergent composition comprising:

a) from about 1% to about 75% of a surfactant;

b) from about 10% to about 95% of water by weight;

c) from about 0.01% to about 5% of an enzyme suitable for use in detergent compositions; and d) an enzyme inhibiting amount of turkey ovomucoid such that prior to use of the detergent, the turkey ovomucoid binds at least about 90% of the enzyme and the remaining enzyme is in its free form, and wherein upon appropriate dilution of the composition at least about 25% of such bound enzyme is released in its free form.

2. A liquid detergent according to claim 1 wherein greater than or equal to 45% of bound enzyme is released in its free form upon dilution of said detergent.

3. A liquid detergent according to claim 1 wherein the enzyme is a protease.

4. A liquid detergent according to claim 2 wherein the enzyme is a protease.

5. A liquid detergent of claim 3 wherein the protease is a subtilisin.

6. A liquid detergent of claim 4 wherein the protease is a subtilisin.

7. A liquid detergent according to claim 3 further comprising a non-protease enzyme.

8. A liquid detergent according to claim 4 further comprising a non-protease enzyme.

9. A liquid detergent according to claim 5 further comprising a non-protease enzyme.

10. A liquid detergent according to claim 6 further comprising a non-protease enzyme.

* * * * *